US005308063A

United States Patent [19]

Vendur

[11] Patent Number: 5,308,063

[45] Date of Patent: May 3, 1994

[54] ADJUSTABLE GOLF CLUB

[76] Inventor: John Vendur, 350 Penrod St., Johnstown, Pa. 15902

[21] Appl. No.: 60,609

[22] Filed: May 11, 1993

[51] Int. Cl.[5] ..... A63B 53/02

[52] U.S. Cl. ..... 273/80.1; 273/80.2

[58] Field of Search ..... 273/77 R, 79, 80.1, 273/80.2, 80.3, 80.4, 80.5, 80.6, 80.7, 80.8, 80.9; 403/104, 106, 107, 108

[56] References Cited

U.S. PATENT DOCUMENTS

| | | | |
|---|---|---|---|
| 1,599,336 | 9/1926 | Lindgren | 273/168 X |
| 1,643,250 | 9/1927 | Longsworth | 273/79 |
| 2,155,830 | 4/1939 | Howard . | |
| 2,325,525 | 7/1943 | Lukenbill . | |
| 2,425,808 | 8/1947 | Jakosky . | |
| 2,571,970 | 10/1951 | Verderber | 273/79 X |
| 2,644,689 | 7/1953 | Putnam . | |
| 2,661,952 | 12/1953 | Jackson | 273/173 X |
| 3,397,888 | 8/1968 | Springer | 273/80.1 |
| 3,885,796 | 5/1975 | King | 273/80.1 X |
| 4,073,492 | 2/1978 | Taylor . | |
| 4,252,317 | 2/1981 | Vezina . | |
| 4,815,740 | 3/1989 | Williams | 273/80.2 X |
| 4,966,369 | 3/1990 | Griffin . | |
| 5,133,553 | 7/1992 | Divnick | 273/79 |

FOREIGN PATENT DOCUMENTS

| | | | |
|---|---|---|---|
| 9006157 | 6/1990 | World Int. Prop. O. | 273/80.1 |

*Primary Examiner*—Vincent Millin
*Assistant Examiner*—Sebastiano Passaniti
*Attorney, Agent, or Firm*—Walter J. Blenko, Jr.; George K. Stacey

[57] ABSTRACT

An adjustable golf club is provided having an elongated handle which is secured to a club head support, the club head support being pivotally secured to a club head. The club head has a planar striking face and a bottom surface. The pivotal axis at which the club head and the club head support are connected is perpendicular to the striking face. The pivotal connection permits the angular orientation between the handle and the bottom surface of the club head to be varied within a plane that is generally parallel to the striking face. A detent engaging the club head and club head support maintains the desired angular orientation between the handle and the bottom surface of the club head.

11 Claims, 2 Drawing Sheets

ADJUSTABLE GOLF CLUB

BACKGROUND OF THE INVENTION

This invention relates to golf clubs. More particularly, the invention relates to a golf club, such as a putter, having a head which is adjustable with respect to the handle.

As used herein, the terms "golf club" and "club" refer to putters and other clubs which conform to The Rules of Golf as approved by The United States Golf Association and the Royal and Ancient Golf Club of St. Andrews, Scotland (the "USGA Rules of Golf" ).

Golf is a game played by many people throughout the world. As with most sports participants, golfers are constantly searching for ways to improve their performance on the course. For example, a golfer may change the way he grips the various clubs, the way he addresses the ball, his stance, his posture and his swing while trying to reduce his score by a few strokes. Putting is one part of the game where golfers typically make many adjustments to their playing style.

When a golfer makes changes to his playing style, the changes may necessitate the use of a club having characteristics different from the club that the player used prior to making the changes. For example, if a player adopts a more upright posture for putting, the change may require that his putter have a greater angle between the handle and the club head to position the end of the handle that the player grips higher off of the ground when the club is in the playing position.

One way to accommodate changes to a golfer's playing style that require different club configurations is for the golfer to obtain a different club each time the change is made. This can be expensive and time consuming. An alternative is to use a club that is adjustable. One problem with adjustable clubs is that they do not typically provide the player with the desired "feel" as can be obtained with conventional clubs. For example, the components of the adjustable club may be become loose, which can be distracting to the player and interfere with the manner in which the club impacts the ball. Another problem associated with adjustable clubs is that many do not conform to the United States Golf Association's rules of golf, and therefore cannot be used in situations which require compliance with such rules.

SUMMARY OF THE INVENTION

I have invented new and useful improvements in an adjustable golf club that overcomes many of the problems associated with currently available adjustable golf clubs. I provide a golf club having an elongated handle with a grip end and a lower end. A golf club head support is secured to the lower end of the handle. A club head is pivotally secured to the club head support. The club head has a generally planar striking surface and a bottom surface. The club head is pivotally secured to the club head support on a pivotal axis that is generally perpendicular to the striking face. The connection from its angular orientation between the handle and the bottom surface of the head to be adjusted in a plane that is generally parallel to the striking face. Detent means are provided for selectively maintaining the angular orientation between the handle and the bottom surface of the club head.

I also provide golf club head that has a generally planar striking face and at least one adjustment surface oriented generally parallel to the striking face. A club head support is pivotally secured to at least one of the adjustment surfaces at a pivot point and on a pivotal axis that is perpendicular to the striking face. The club head support includes handle securing means for engaging an upwardly extending handle and maintaining the handle in a plane that is generally parallel to the striking face. Detent means engaging at least one of the adjustment surfaces and the club head support are operative for selectively maintaining the angular orientation about the pivot point of a point on the club head support.

Other details, objects and advantages of my invention will become more apparent as the following description of the present preferred embodiment proceeds.

BRIEF DESCRIPTION OF THE DRAWINGS

In the accompanying drawings, I have illustrated a present preferred embodiment of my invention in which.

DETAILED DESCRIPTION OF PREFERRED EMBODIMENT

Figure 1:
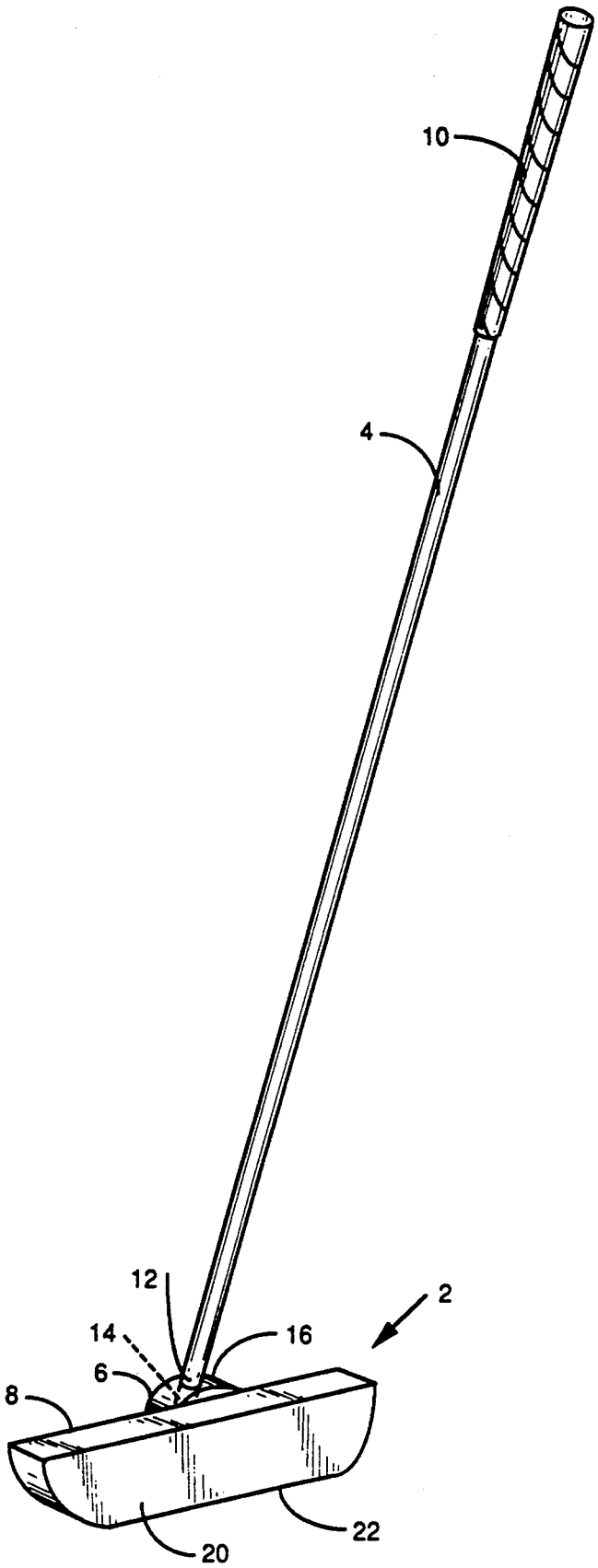
FIG. 1 is a front perspective view of a golf club embodying my invention.
Figure 2:
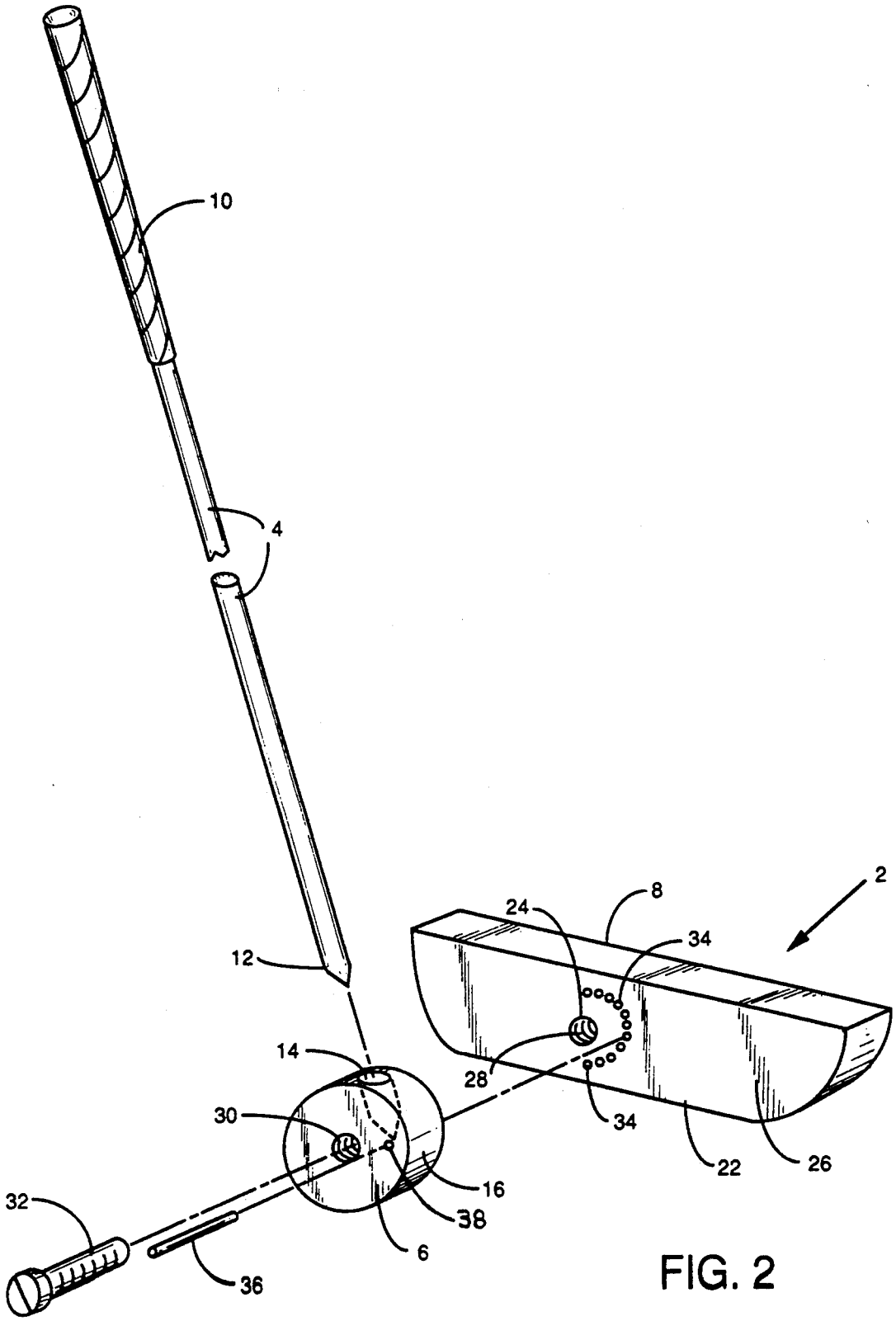
FIG. 2 is an exploded rear perspective view of the golf club of FIG. 1.

Referring to FIGS. 1 and 2, a preferred embodiment of the golf club of my invention is an adjustable putter 2. Putter 2 includes an elongated handle 4, a club head support 6 and the club head 8. Handle 4 includes a gripping end 10 and a lower end 12. Club head support 6 is secured to lower end 12 of handle 4. Preferably, club head support 6 includes handle engaging means which include a radially extending opening 14 in which lower end 12 of handle 4 is received and secured. Club head support 6 is preferably generally circular in shape. Opening 14 is provided at a point on peripheral edge 16 of club head support 6.

Club head 8 has a generally parallel striking face 20 and a bottom surface 22. Bottom surface 22 normally rests on the ground when the golfer is addressing the ball. The angle of striking face 20 to the ground is dependent upon the loft that the club is intended to impart the ball. Club head 8 is pivotally secured to club head support 6 on a pivotal axis that is generally perpendicular to striking face 20. Club head support 6 is preferably secured to club head 8 at a pivot point 24 on adjustment surface 26. Adjustment surface 26 is preferably generally parallel to striking face 20 and is located on the opposite side of the club head from striking face 20. Threaded opening 28 is provided in adjustment surface 26. A central opening 30 is provided in club head support 6. Pivot screw 32 is received through central opening 30 and into threaded opening 28, thereby pivotally securing club head 8 to club head support 6. Threads on screw 32 engage the threads within opening 28. Tightening screw 32 will retard pivotal movement of the club head 8 with respect to club head support 6.

When club head 8 and club head support 6 are secured to one another, handle 4 extends generally upward in a plane that is generally parallel to striking face 20. The pivotal connection between club head 8 and club head support 6 permits adjustment of the angular orientation between handle 4 and bottom surface 22 in the plane in which handle 4 lies.

Detent means are provided engaging club head 8 and club head support 6 and operative for selectively maintaining the angular orientation between handle 4 and bottom surface 22. The detent means preferably include a plurality of angularly spaced apertures 34 in adjustment surface 26 of club head 8, and a locking pin 36 positioned to engage club head support 6 and individually engage apertures 34. Locking pin 36 is received into opening 38 in club head support 6 and into one of the apertures 34, thereby resisting relative movement between the club head 8 and club head support 6 about pivot point 24.

The angular orientation between handle 4 and bottom surface 22 may be selectively varied between positive and negative inclinations from perpendicular with respect to bottom surface 22. In a preferred embodiment, however, apertures 34 are positioned so that the minimum angular orientation between handle 4 and bottom surface 22 will be 10° from perpendicular with respect to bottom surface 22. This is required to conform with the current USGA Rules of Golf. Apertures 34 are preferably positioned to permit the angular orientation between handle 4 and bottom surface 22 to be selectively positioned at orientations between about 10° and 90° from perpendicular with respect to bottom surface 22. In the preferred embodiment, eleven apertures 34 are provided spaced from one another at about 4.5° intervals with respect to pivot point 24.

To adjust the angular orientation between handle 4 and bottom surface 22, locking pin 36 is disengaged from an aperture 34. Once locking pin 36 is disengaged, club head 8 is free to pivot about pivot point 24, and the desired angular orientation between handle 4 and bottom surface 22 may be set. Once the desired angular orientation is obtained, locking pin 36 is pushed in to engage the aperture 34 corresponding to the desired angular orientation. Re-engagement of locking pin 36 resists pivotal movement of club head 8 relative to club head support 6. It will be appreciated that repeated adjustments to the angular orientation may be made in this manner.

The embodiment of the golf club shown in FIGS. 1 and 2 is a putter for use by a right-handed golfer. It will be appreciated that my invention is equally adaptable for clubs for left-handed golfer and, further, can be utilized for clubs that are adaptable for use by either right-handed or left-handed players.

While I have illustrated and described a certain present preferred embodiment of my invention, it is to be understood that I do not limit myself thereto and that the invention may be otherwise variously practiced within the scope of the following claims.

I claim:

1. A golf club comprising:

an elongated handle having a grip end and a lower end;

a club head support secured to said lower end of said handle;

a club head having a generally planar striking face and a bottom surface, said club head being pivotally secured to said club head support on a pivotal axis generally perpendicular to said striking face, whereby angular orientation between said handle and said bottom surface is selectively adjustable in a plane generally parallel to said striking face between positive and negative inclinations from perpendicular with respect to said bottom surface; and detent means engaging said club head and said club head support and operative for selectively maintaining the angular orientation between said handle and said bottom surface, said detent means including a plurality of angularly spaced apertures in said club head, and a locking pin positioned to engage said club head support and individually engage said apertures to selectively maintain the angular orientation between said handle and said bottom surface.

2. The golf club of claim 1, wherein said apertures are positioned to permit the angular orientation between said handle and said bottom surface to be selectively positioned at an orientation of about 10° to 90° from perpendicular with respect to said bottom surface.

3. The golf club of claim 2, wherein said locking pin is received into an opening in said club, head support.

4. The golf club of claim 3, wherein said club head support includes a generally radially extending opening in which said shaft is received and secured.

5. The golf club of claim 4, wherein said club head support is generally circular in shape.

6. A golf club head comprising a generally planar striking;

at least one adjustment surface oriented generally parallel to said striking face;

a club head support pivotally secured at a pivot point to at least one of said adjustment surfaces and on a pivotal axis that is generally perpendicular to said striking face, said club head support having handle securing means thereon for engaging an upwardly extending handle and maintaining said handle in a plane generally parallel to said striking face;

detent means engaging said at least one adjustment surface and said club head support and operative for selectively maintaining the angular orientation about the pivot point of a point on said club head support such that the angular orientation of the point on said club head support is selectively variable between positive and negative inclinations with respect to an axis oriented generally parallel to said face and extending from the pivot point; and said detent means including a plurality of angularly spaced apertures in said at least one adjustment surface, and a locking pin positioned to engage said club head support and individually engage said apertures to selectively maintain the angular orientation of the point on said club head support.

7. The golf club head of claim 6, wherein said apertures are positioned to permit angular adjustment of said club head support such that the point on said club head support may be selectively positioned at an orientation of about 10° to 90° the axis.

8. The golf club head of claim 7, wherein said locking pin is received into an opening in said club head support.

9. The golf club head of claim 8, wherein said club head includes one adjustment surface.

10. The golf club head of claim 9, wherein said handle securing means includes a generally radially extending opening in said club head support in which said shaft is received and secured.

11. The golf club head of claim 10, wherein said club head support is generally circular in shape.

* * * * *

UNITED STATES PATENT AND TRADEMARK OFFICE

CERTIFICATE OF CORRECTION

PATENT NO. : 5,308,063

DATED : May 3, 1994

INVENTOR(S) : JOHN VENDUR

It is certified that error appears in the above-indentified patent and that said Letters Patent is hereby corrected as shown below:

Claim 6, column 4, line 24, --face-- should be inserted after "striking".

Signed and Sealed this

Thirtieth Day of August, 1994

*Attest:*

*Attesting Officer*

Bruce Lehman

BRUCE LEHMAN

*Commissioner of Patents and Trademarks*